US008786439B2

(12) United States Patent
Yang et al.

(10) Patent No.: US 8,786,439 B2
(45) Date of Patent: Jul. 22, 2014

(54) ACTIVE ANTENNA

(75) Inventors: Xiao Hui Yang, Saratoga, CA (US); Guo Yin, Shanghai (CH)

(73) Assignee: WG Security Products, Campbell, CA (US)

( * ) Notice: Subject to any disclaimer, the term of this patent is extended or adjusted under 35 U.S.C. 154(b) by 1339 days.

(21) Appl. No.: 11/513,779

(22) Filed: Aug. 31, 2006

(65) Prior Publication Data

US 2011/0095889 A1 Apr. 28, 2011

Related U.S. Application Data

(60) Provisional application No. 60/713,796, filed on Sep. 2, 2005.

(51) Int. Cl.
*G08B 13/14* (2006.01)

(52) U.S. Cl.
USPC ..... 340/572.1

(58) Field of Classification Search
USPC ..... 340/568.1, 572.1, 572.4, 572.5, 572.7, 340/10.1–10.6
See application file for complete search history.

(56) References Cited

U.S. PATENT DOCUMENTS

| | | | | | |
|---|---|---|---|---|---|
| 4,667,185 | A * | 5/1987 | Nourse et al. | ..... | 340/572.4 |
| 4,870,391 | A * | 9/1989 | Cooper | ..... | 340/572.5 |
| 5,262,772 | A * | 11/1993 | Urbas et al. | ..... | 340/10.6 |
| 5,353,011 | A * | 10/1994 | Wheeler et al. | ..... | 340/572.4 |
| 5,495,229 | A * | 2/1996 | Balch et al. | ..... | 340/572.4 |
| 5,661,457 | A * | 8/1997 | Ghaffari et al. | ..... | 340/572.7 |
| 5,815,076 | A * | 9/1998 | Herring | ..... | 340/572.5 |
| 5,883,574 | A * | 3/1999 | .ANG.sbrink | ..... | 340/572.5 |
| 6,249,229 | B1 * | 6/2001 | Eckstein et al. | ..... | 340/572.4 |
| 6,958,695 | B1 * | 10/2005 | Imafuku | ..... | 340/568.1 |
| 7,046,144 | B2 * | 5/2006 | Stephen-Daly et al. | ... | 340/568.1 |
| 2002/0175805 | A9 * | 11/2002 | Armstrong et al. | ..... | 340/10.31 |

* cited by examiner

*Primary Examiner* — Brian Zimmerman
*Assistant Examiner* — Kevin Lau
(74) *Attorney, Agent, or Firm* — Robert R. Waters; Brian W. Foxworthy; Waters Law Group, PLLC

(57) ABSTRACT

An EAS system comprises a central circuit for sequentially generating signal bursts. At least one local transmitting antenna is positioned remote from the central circuit for receiving and propagating the signal bursts into an interrogation zone. A receiver is associated with the local transmitting antenna for detecting the presence of an electronic tag in the interrogation zone by means of a response tag signal from the electronic tag and transmitting the response tag signal to the central circuit. A synchronization device is provided for detecting the signal burst propagated from the local transmitting antenna, and controls the activation of the receiver for the purpose of receiving the response tag signal based on the timing of the signal burst.

25 Claims, 12 Drawing Sheets

Due to the formula of Diff AMP output $$V_o = V_{i1} - V_{i2}$$

Any common mode noise received by the ferrite antenna will appear with same value on both Vi1 input and Vi2 input, so the output of Diff AMP will get pure AC tag signal + non common mode noise with self deduction of the common mode noise Here is a normal amplifier circuit The disclosed circuit has a LC frequency select circuit connected in parallel to the Rs resistor and function as a band pass filter.

The band select frequency is calculated as $f0 = \frac{1}{2\pi\sqrt{LC}}$ (give the former amplifier gain is A0)

ACTIVE ANTENNA

CROSS REFERENCE TO RELATED APPLICATIONS

This application claims the benefit of U.S. Provisional Patent Application No. 60/713,796 filed Sep. 2, 2005 which is incorporated herein by reference in its entirety.

FIELD AND BACKGROUND OF THE INVENTION

EAS (electronic article surveillance) systems are often installed in a variety of challenging and difficult environments where various noise sources may interfere with the operation of the system. EAS systems are typically installed at retail or other outlets for the purpose of inventory control, to detect the presence of articles exiting a store or other area and to prevent theft or unauthorized removal of such articles. Articles are tagged with appropriate security devices which emit signals detected by the EAS system when an article is in the detection range of the system, (also referred to as the interrogation zone), triggering an alarm. Under normal circumstances, the security device is removed by store personnel at the point of sale to prevent such an alarm from being routinely and unnecessarily triggered.

Some of the principal features and operations of EAS systems, such as those discussed in the present invention, are as follows:

(1) A transmission circuit generates a burst signal at a given operating frequency. This signal is radiated into the interrogation zone through which the tagged article might pass.

(2) If a tag is present in the interrogation zone, the tag will respond to the transmission field by resonating or oscillating in sympathy with the stimulus field, analogous to a tuning fork being struck by an impulse.

(3) Immediately following the cessation of the transmission burst, the antennas in the system will pick up the resonant response of the tag. This is a weak signal, necessitating high sensitivity to low-level signals, immediately following the transmission of a much larger stimulus signal.

(4) If this weak resonant tag response is detected, the system will produce an alarm indicating to store personnel the presence of a tag (i.e. a tagged article) passing through the interrogation zone.

In order to be effective, the EAS system must be sufficiently sensitive to the weak tag response signal following the transmission burst, but not be sensitive to electrical or other noise present in the environment which may be picked up by the system and thereafter produce false alarms.

SUMMARY OF THE INVENTION

According to one aspect of the invention, there is provided an EAS system comprising a central circuit for sequentially generating signal bursts; at least one local transmitting antenna remote from the central circuit for receiving and propagating the signal bursts into an interrogation zone; a receiver associated with the local transmitting antenna for detecting the presence of an electronic tag in the interrogation zone by means of a response tag signal from the electronic tag and transmitting the response tag signal to the central circuit; and a synchronization device for detecting the signal burst propagated from the local transmitting antenna, the synchronisation device controlling the activation of the receiver for the purpose of receiving the response tag signal based on the timing of the signal burst.

Preferably, the EAS system comprises a plurality of local transmitting antennas each positioned in a different location.

In an preferred form, the EAS system further comprises means for increasing the signal to noise ratio of the return tag signal. The means for increasing signal to noise ratio may comprise a differential amplifier for amplifying the return tag signal and/or suppressing common mode noise.

Preferably, the EAS system has a receiver which includes a receiving antenna which is comprised of a ferrite rod front end antenna. The ferrite rod front end antenna may comprise an LC circuit which is comprised of a ferrite rod coil connected in parallel with at least one capacitor.

In one embodiment, several receivers are provided locally, some of the receivers being mounted substantially vertically and other of the receivers being mounted substantially horizontally to provide fuller coverage for detecting the tag in the interrogation zone.

The synchronisation device may include a Tx burst sensor for detecting the signal bursts; a microprocessor (MCU) to provide synchronization detection and timing control signals for switching elements to reduce ringing.

Preferably, means for suppressing transients resulting from the signal burst are provided so that a detection window during which the receiver operates is sufficiently quiet to detect only the return tag signal.

The receiver may include a receiving antenna and/or a receiving coil.

According to another aspect of the invention, there is provided a local EAS detection device comprising at least one local transmitting antenna for receiving sequentially generated signal bursts from a central remote circuit and transmitting the signal bursts into an interrogation zone; a receiver associated with the local transmitting antenna for detecting the presence of an electronic tag in the interrogation zone by means of a return tag signal from the electronic tag and transmitting the return tag signal to the central circuit; and a synchronization device for detecting the signal burst transmitted from the local transmitting antenna, the synchronisation device controlling the activation of the receiver for the purpose of receiving the return tag signal based on the timing of the signal burst.

The present invention discloses in one aspect a method for optimizing the operation of an EAS system, in particular an EAS system that comprises multiple interrogation zones or multiple antenna systems. Such multiple systems present unique problems related to the spatial distribution and cabling of the interrogation zones and their connection to a central EAS control system. The present invention discloses methods and apparatus for improving the performance of EAS systems that comprise, in various embodiments, distributed circuits, wherein each interrogation zone preferably has its own or locally shared antenna, detection, amplification, and gating system local to the zone or more than one zone but only a portion of the total system, with each local system being connected to a central system.

Thus, in one embodiment, the EAS system has a central circuit and a plurality of local transmitting and receiving antennas, wherein the operational synchronization required for proper detection between the transmitting and receiving antennas is controlled locally (i.e. at the local transmitting and receiving antennas) and not from the central circuit. Such an arrangement has the beneficial result that additional cabling or wiring is not required from the central circuit to the local antennas to effect synchronization. The presence of such cabling or wires may increase noise and thereby reduce the effectiveness of the detection system. Further, cabling the synchronization may result in the signal being corrupted by other environmental and/or ambient noise which may result in a compromised system of detection.

Specifically, the present invention addresses in one aspect thereof problems of noise within the local detection and amplification circuits, noise induced by cabling from the detection circuit to the central system, and noise and interference as a result of cabling between system elements due to synchronization signals used for gate timing.

Some of the possible noise sources which may interfere with the system may include radiation noise and power line noise. In order to improve upon the signal to noise ratio (S/N ratio), and enhance the sensitivity of the system for the detection of tagged articles which may be passing through the system, the external noise (i.e. from sources other than the security device on an article) received by system must be decreased to a minimum or an acceptable level, so that the system will not be degraded by external noise in the environment. In this way, the frequency of false triggering events caused to the detection system can be significantly reduced.

Another purpose of the noise suppression technology is to facilitate the signal transmission from an external or remote antenna to a receiver circuit board which may be a distance from the antenna. Usually, a receiver circuit board will receive multiple channels of signals from different antennas located at different positions in the store or interrogation zones for better detection coverage. In other cases, a universal multiple channel control unit will be connected to several antenna pedestals which could be arranged at different locations in a shop or store. Long signal transmission cables may often be required in such configurations, ranging in length from a few feet to even hundreds of feet. The presence of these cables may well introduce additional noise, into the EAS system, presenting additional system design challenges.

In an effort to address the significant challenges of environmental noise on the design of EAS systems, one aspect of the present invention relates to an improved noise process technology which preferably includes one or more of the following criteria:

(1) The system may utilize a ferrite rod antenna with resonance capacitors forming a high-sensitivity front-end antenna tuned to the frequency of interest.

(2) The system may be designed to cancel or to significantly suppress the common mode noise by using differential front-end amplifiers.

(3) The system may additionally include one or more band-pass filter/amplifiers following the differential amplifier stage. These band-pass stages filter and condition the signal for transmission of higher S/N ratio signals over cables to the central system.

(4) The system may allow for dynamic switching of the LC circuit and/or amplifiers in the signal 'path to minimize the receiving antenna's (LC circuit) ringing transients, which degrade signal detection during the time period when the tag signal must be detected (detection window).

(5) The system may provide an integrated transmitting burst sensor to provide a local synchronization source instead of having to use a central synchronization signal from the receiver board located far away.

DETAILED DESCRIPTION OF THE INVENTION

Figure 1:
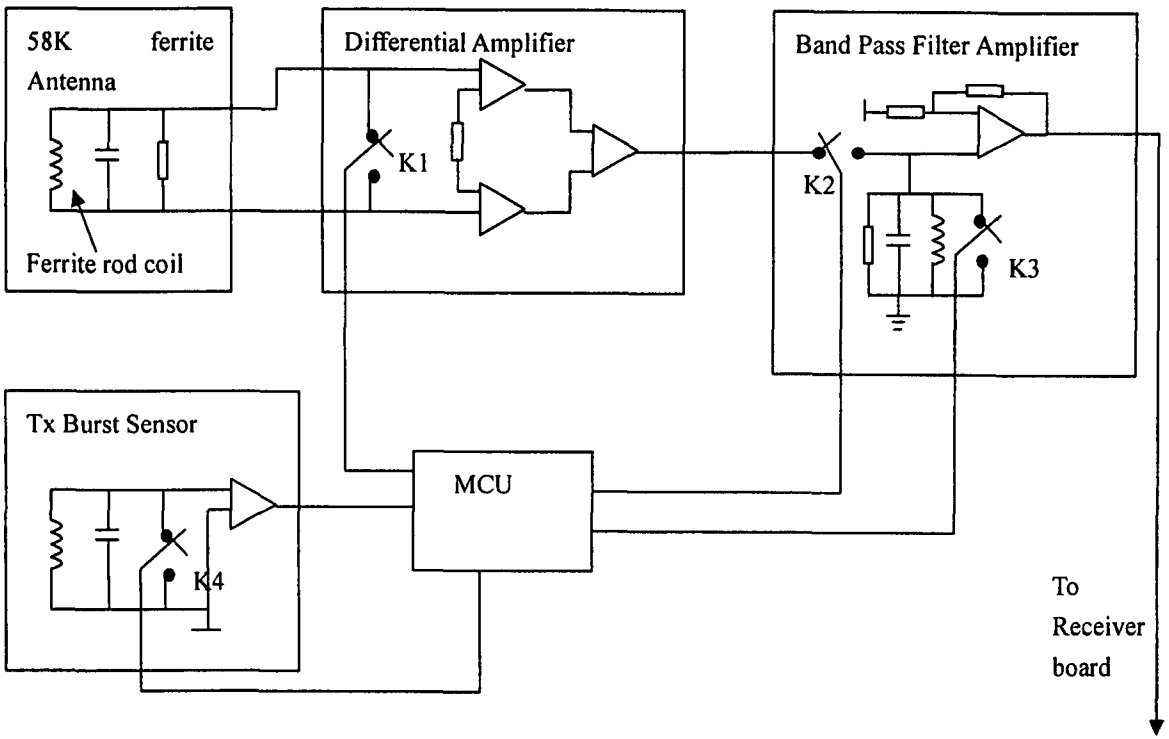
FIG. 1 is a system diagram in accordance with one aspect of the present invention.

Referring to FIG. 1 of the drawings, there is shown a detection system in accordance with one aspect of the invention and including a ferrite rod front end antenna.

Ferrite Rod Front End Antenna

The ferrite rod front end antenna is an LC circuit (inductor and capacitor) composed of a ferrite rod coil connected in parallel with a series of capacitors which could in accordance with one embodiment be selected by jumpers to fine tune the operating frequency of an acousto-magnetic system at, say, 58 kHz center frequency.

Some of the advantages and benefits of the ferrite rod front end antenna are as follows:

(1) More gain and more sensitivity compared with common coil antennas.

(2) More suppression of out-of-band noise due to the frequency selectivity of the LC circuit.

(3) Strong detection orientation/polarization due to the receiving beam angle, and this may be especially suitable for arrangements and systems with multiple antennas at different locations and different orientations in the interrogation zone, to compensate for some dead zones in the EAS interrogation field zone.

Some active antennas are mounted in a vertical orientation/polarization so as to pick up or detect the presence of tags entering the interrogation zone substantially vertically and other active antennas are mounted in an horizontal orientation/polarization so as to pick up or detect the presence of tags entering the interrogation zone substantially horizontally. Thus the whole detection or interrogation zone will have better coverage by using both the substantially vertical and horizontal orientations.

FIG. 1 of the drawings illustrates a system diagram showing the signal path and circuitry from a ferrite rod antenna via differential amplifier and band-pass amplifier to a receiver board connection cable. Also shown is the Tx burst sensor and an MCU to provide synchronization detection and timing control signals for switching elements to reduce ringing.

Figure 2:
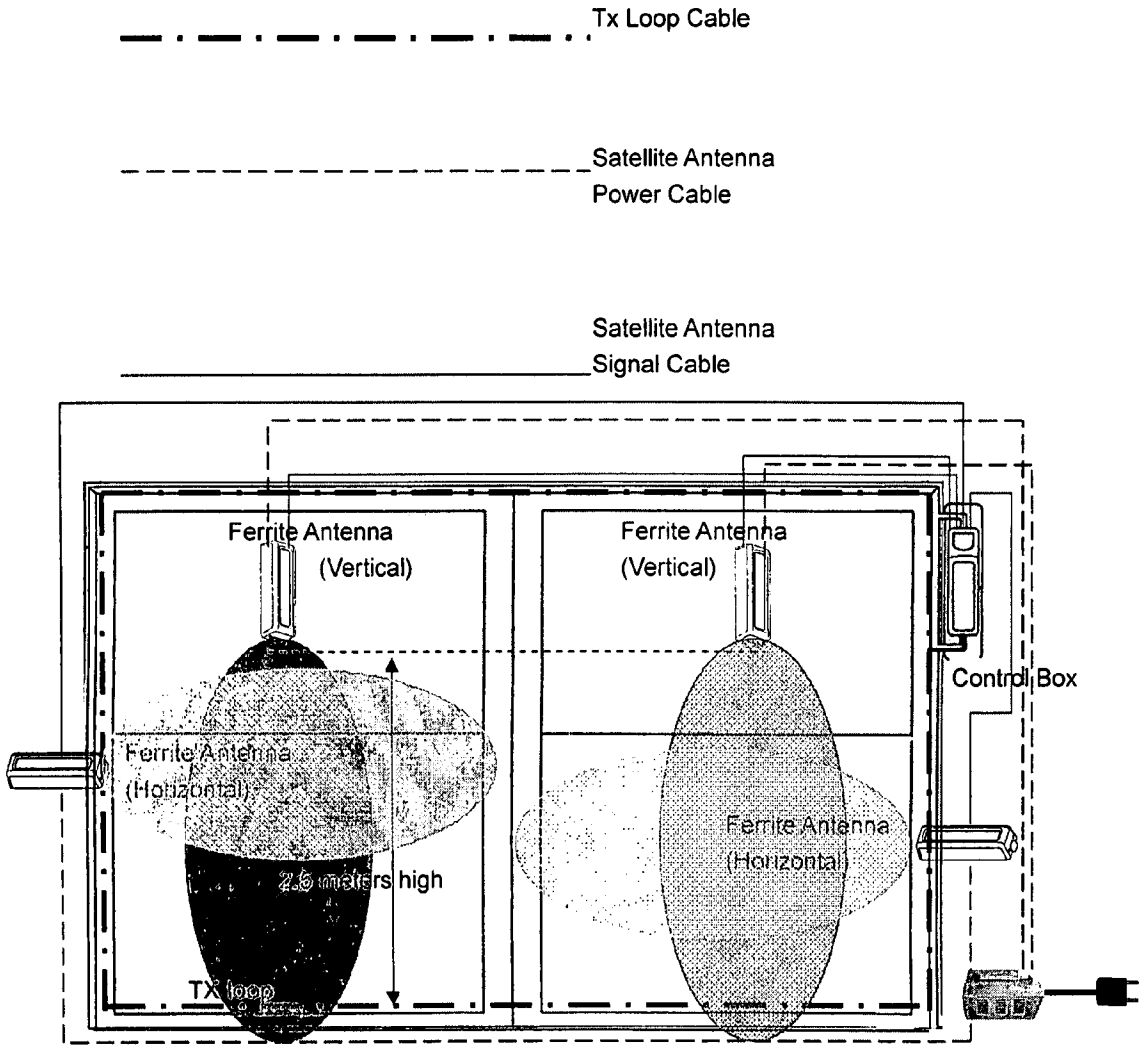
FIG. 2 is a schematic illustration of the topology and physical layout of various components which may be utilized in a an EAS detection system in accordance with one aspect of the invention.

FIG. 2 is a schematic illustration of the topology and physical layout of a detection system in accordance with one aspect of the invention of multiple interrogation zones, multiple antenna polarities, with each antenna preferably having a distributed detection sub-system as shown in FIG. 1 of the drawings. The cabling requirements for connecting the various components of the system are also shown.

Figure 3:
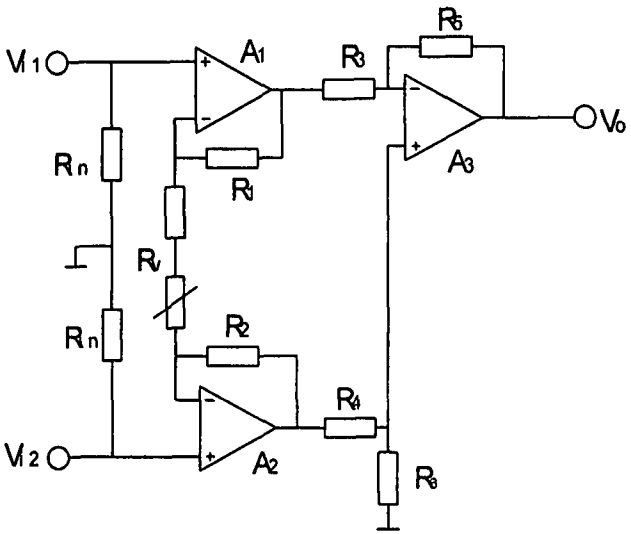
FIG. 3 illustrates a differential amplifier with high common-mode rejection.

Differential Amplifier (See FIG. 3 of the Drawings)

Traditional EAS systems usually use a single ended amplifier based on cost and power considerations. However, single-ended amplifiers used with ferrite-coil antennas are excessively sensitive to common-mode noise. A differential amplifier used with the ferrite antenna addresses this problem, preferably minimizing the sensitivity to common mode noise coming from air or other possible sources.

Figure 4:
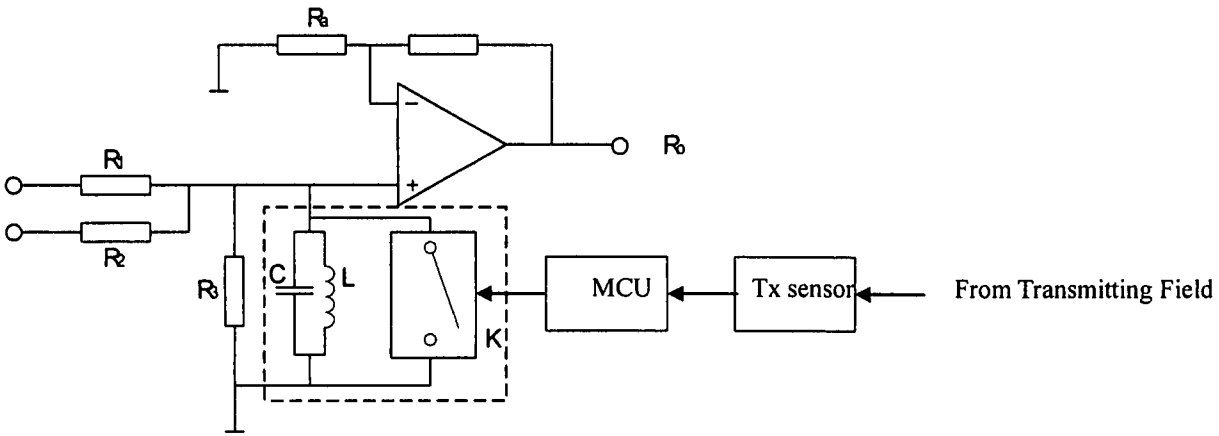
FIG. 4 illustrates a tuned band-pass amplifier with LC tuning circuit and ringing suppression switch, controlled by a microprocessor MCU with timing detected by the Tx sensor.

Band Pass Frequency Select Amplifier (See FIG. 4 of the Drawings)

After the action of the differential amplifier, the common mode noise may have been reduced, substantially eliminated or attenuated. The tag signal still may contain out-of-band noise and may still not be suitable for the long range transmission thereof from the antenna end to the central controller and/or receiver board. A second amplification stage may be applied with a band-pass frequency response to further improve the signal to noise ratio of the signal transmitted via cable to the central system.

Figure 5:
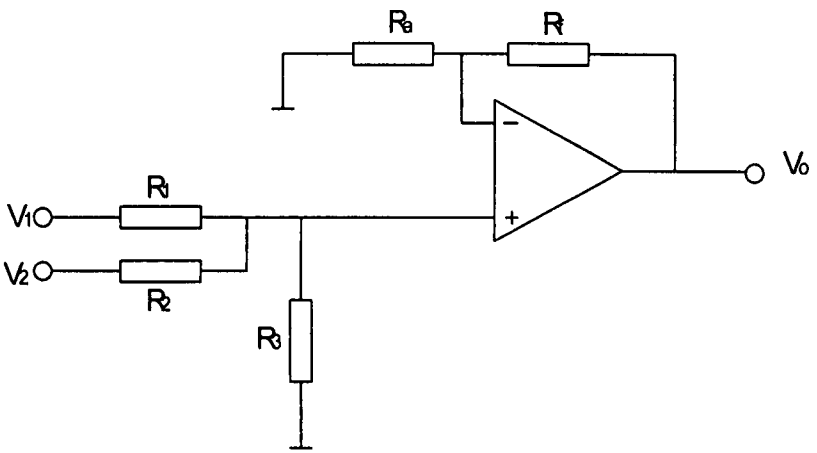
FIG. 5 is a conventional amplifier circuit similar to that shown in FIG. 4 of the drawings but without the LC tuning elements.
Figure 6:
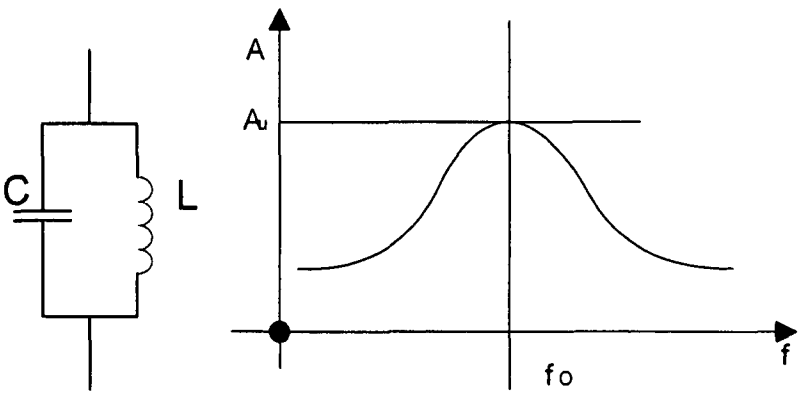
FIG. 6 illustrates an LC resonant circuit with the associated frequency response diagram.
Figure 7:
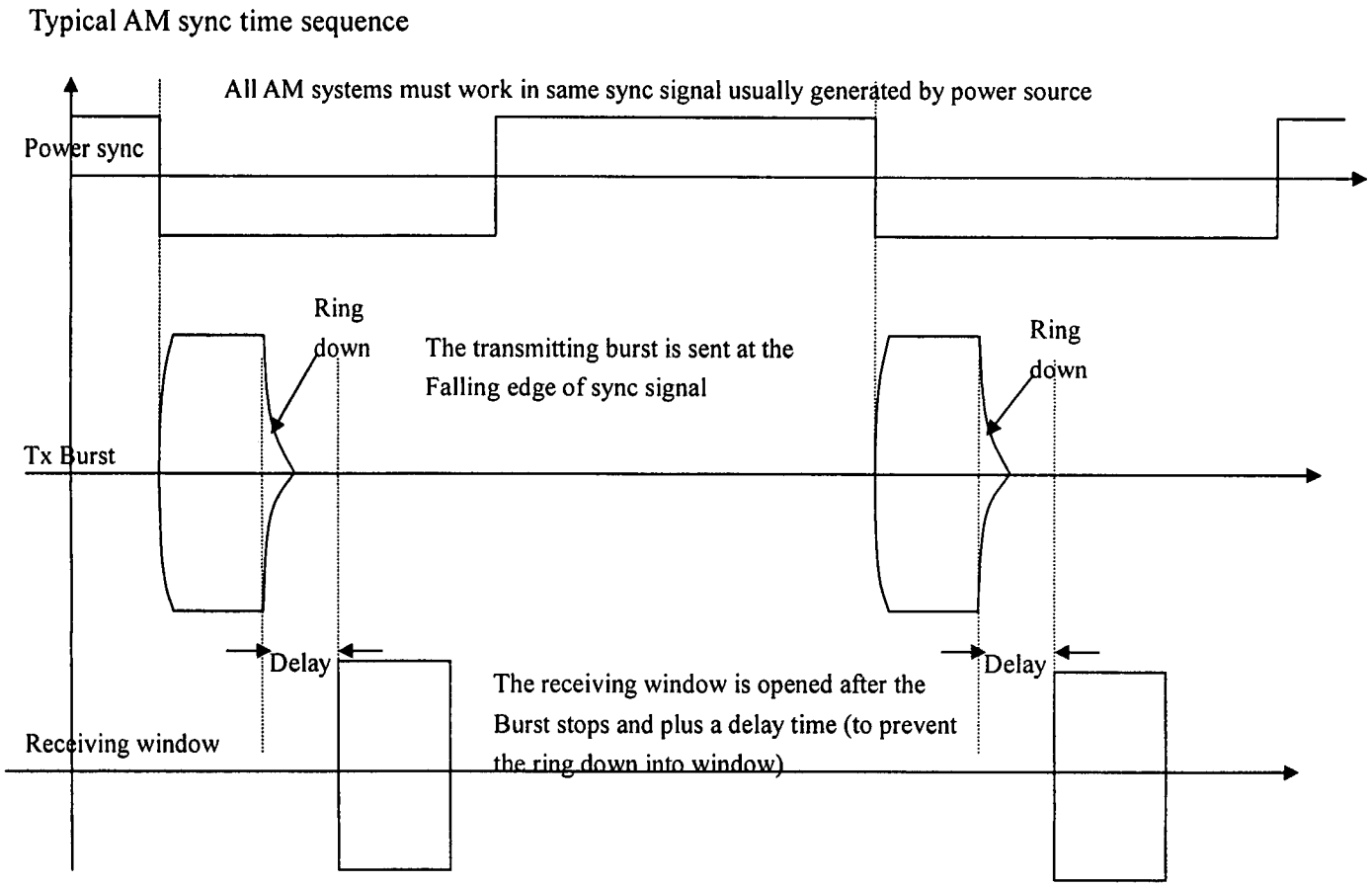
FIG. 7 is a schematic representation illustrating a typical AM synchronization timing sequence showing the transmission burst, ring decay, time delay, and detection window for detecting the tag response.
Figure 8:
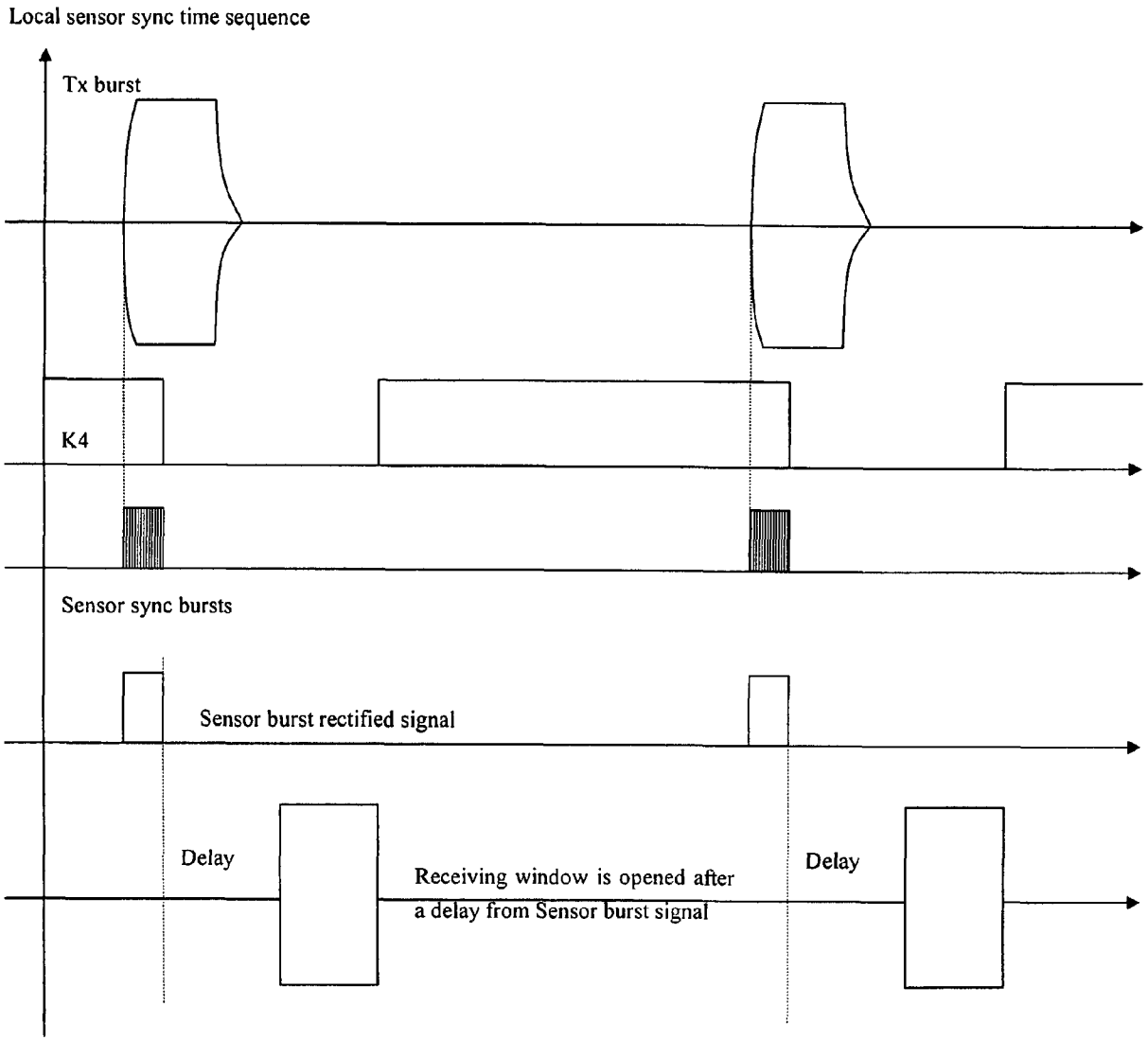
FIG. 8 illustrates the Tx sensor timing for locally sensing transmitter timing.
Figure 9:
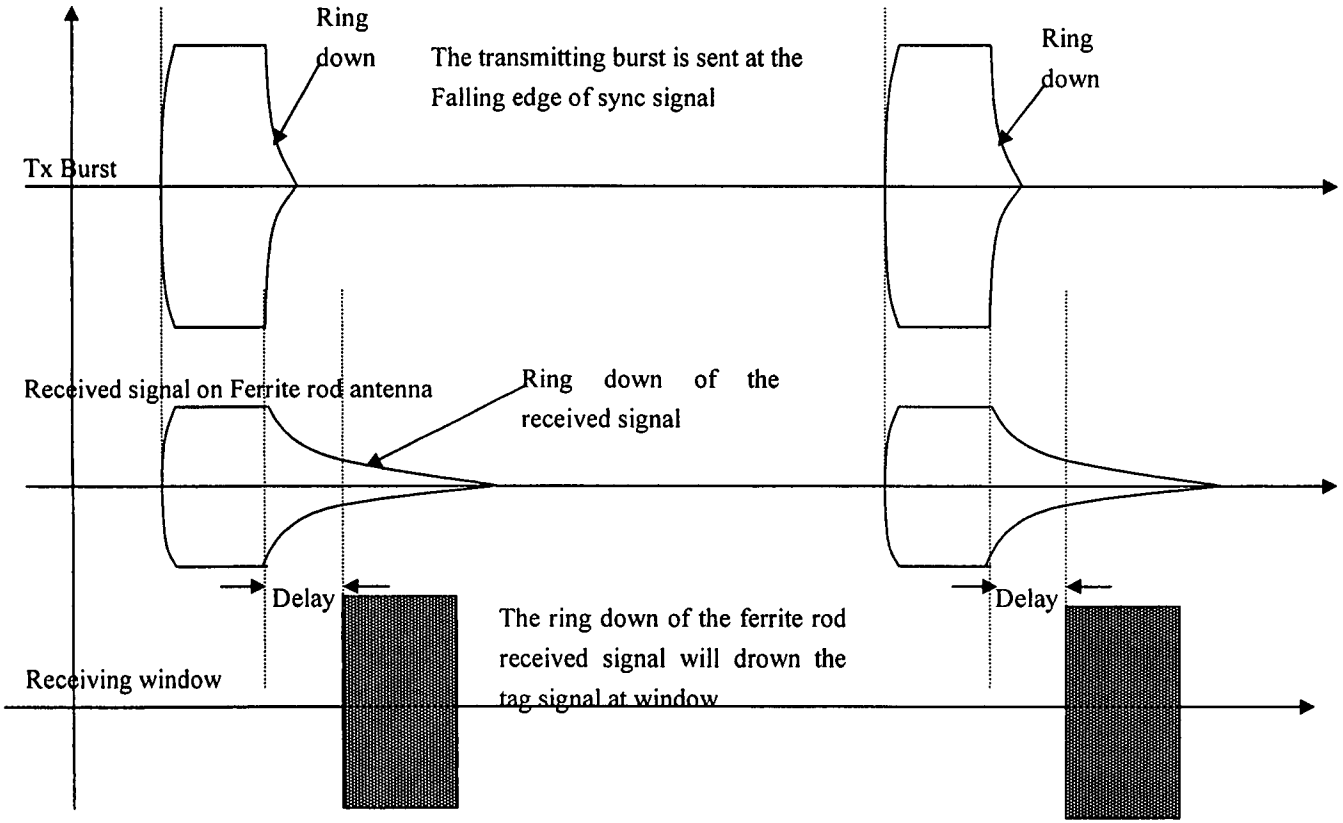
FIG. 9 illustrates the decay and delay of various components of a tag detection circuit including the extent of ring down of the received signal and the overlap thereof with the timing of the receiving window.

One aspect of the band pass filter is to utilize an LC circuit (which may be comprised of a tuning inductor and a capacitor set). Unlike a typical amplifier (as schematically shown in FIG. 5 of the drawings) which has a broader amplification frequency, the band-select feature of the LC connected in parallel (as shown in FIG. 6 of the drawings) will suppress the out of band noise and amplify the in band signal without attenuation.

Tx Burst Sensor and Local Synchronization Generator

Existing active antennas of AM systems usually require a robust synchronization signal. This is typically generated by a central controller. However, in a system with distributed detection and signal gating, such as that disclosed in the present invention, distribution of the synchronization signal may pose a problem. With long cabling to each distributed front-end detection circuit, cable delays introduce both delay and jitter into the synchronization signal, degrading the precision and accuracy of the gating process within each front-end gating circuit.

Transmitting the synchronization signal creates a further problem of both being corrupted by environmental noise, as well as itself radiating noise into the environment due to fast-rising edges in the synchronization signal. This further adds to the jitter problem, as well as producing increased false alarms.

The present invention (see FIG. 11, TX Burst Sensor) uses a small ferrite rod sensor to detect the transmission burst very accurately. A microcontroller (MCU) performs further processing to generate the required timing. This is then used to generate a local synchronization signal which can then be used for gating. This obviates the need for distributing synchronization signals over cables with all the attendant problems. Cabling is preferably reduced, installation cost is preferably reduced, noise and jitter is preferably reduced, and timing accuracy is preferably increased. In a highly distributed system with long distances between detection or interrogation zones and the central system or receiver circuit board, this feature of the invention can become particularly beneficial.

Dynamic Switching Method

One potential problem with using an LC circuit for pulsed signal receiving purposes is the transient ringing of the circuit which could degrade system performance. The transmitter produces an interrogation burst, and following this burst, the system must ensure that transients in all circuits due to the transmitter burst are suppressed so that the detection window period is sufficiently quiet to only detect the weak tag response. If transmission transients decay sufficiently slowly that they occur during the detection window opening, this decaying signal could be confused with the tag response, and due to their strength would most likely be far larger than any tag response. It is thus somewhat important to ensure that the system is devoid of transmission signal transient decay during the detection window or that such transmission signal transient decay is not sufficiently large so as to produce false positive triggering of the alarm during the detection window opening period.

Usually the receiving window opens after a certain delay time to avoid or further reduce the possibility of the ringing of the Tx burst entering the detection window. The Tx burst signal strength and amplitude may be hundreds or even thousands times bigger than the weak tag signal. Though the ring decay of the Tx burst may attenuate quickly, there is still the risk that a fragment of the of the Tx transient ring will overwhelm the weaker tag signal received in the receiving window. It is for this reason that the delay in the opening of the receiving window is usually about two times the ringing period.

Decaying transients from transmission can occur in either the transmitter circuit, the detection circuit, or both.

Figure 10:
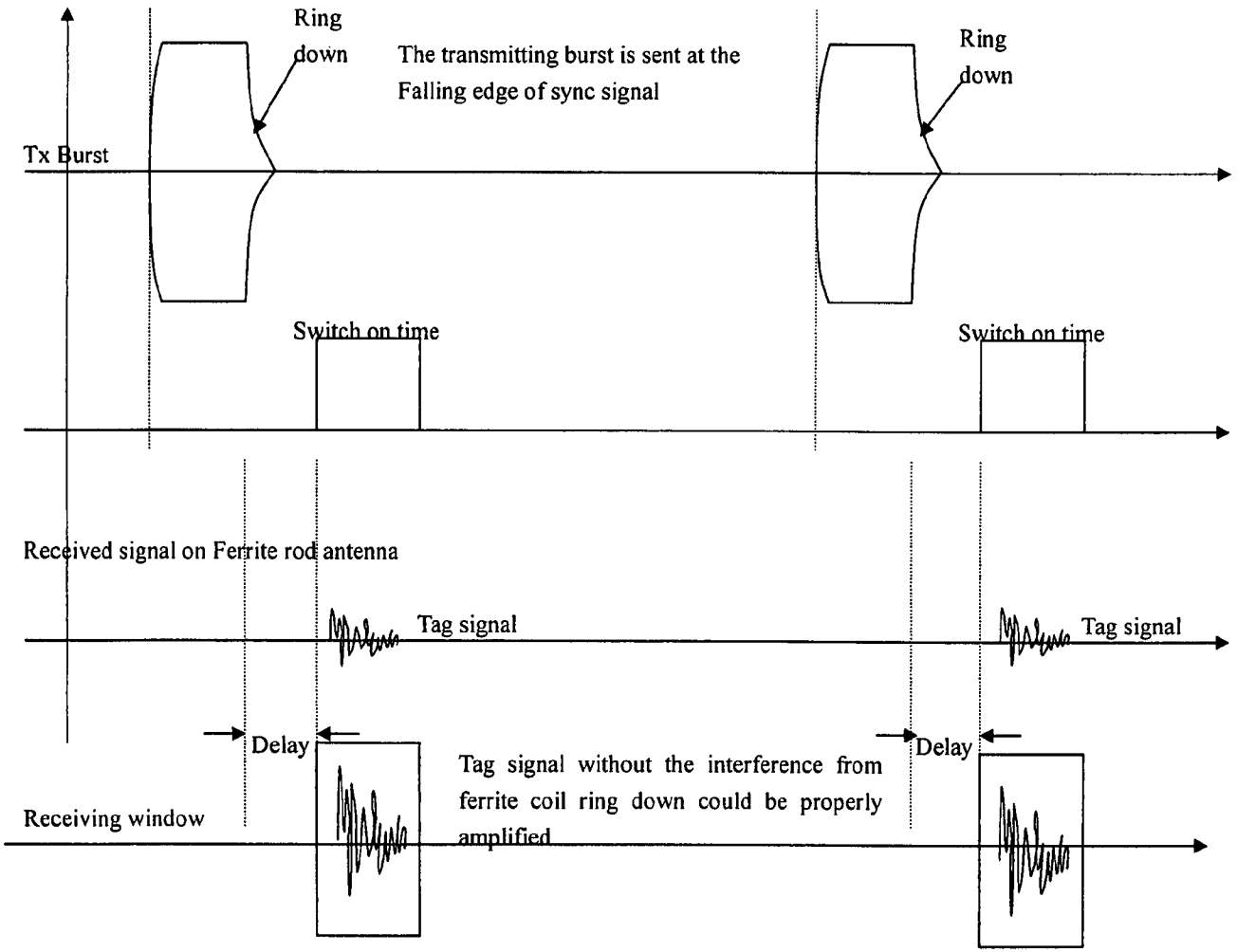
FIG. 10 illustrates various parameters and on/off time of components of the system in accordance with one aspect of the invention.

The LC ferrite rod antenna in the detector, which has a higher Q value compared to the highly tuned transmitter circuit, will be prone to have an extended ring decay period if excited by the transmitting burst. If it is working when there is a transmitting burst, the "tail" of the ferrite rod response will overlap the receiving window just like the transmitter's ring decay. For this reason, the LC ferrite rod antenna must be switched off when the transmitter is on i.e. switched off except during the receiving window shown in the diagram sequences in FIGS. 7 through 10 of the drawings. FIG. 10 of the drawings shows the "switch on time" of the LC ferrite rod antenna necessary for this purpose, and which corresponds to the opening of the receiving window.

Actually, the dynamic switching control by MCU on the various switches K1, K2 and K3 (see FIGS. 1 and 11) all along the receiving signal path prevents the LC circuit ring decay from occurring by shutting down the LC circuit or bypassing the LC circuit during the transmitting burst period.

Figure 11:
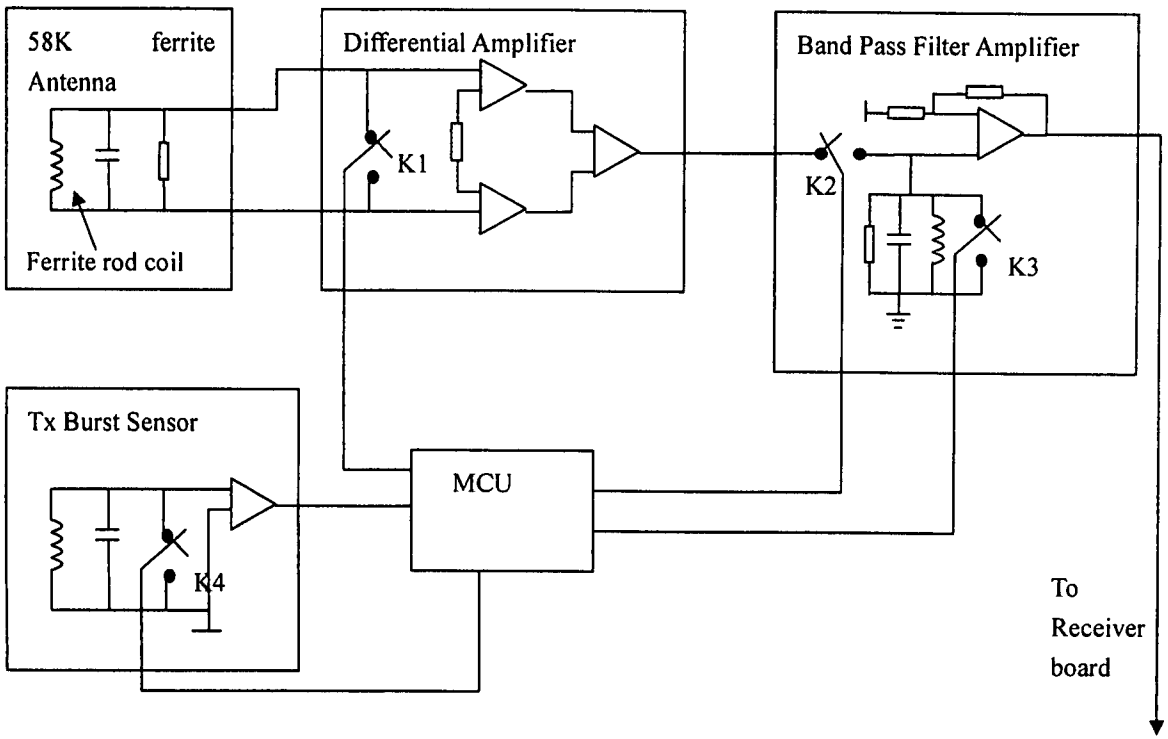
FIG. 11 is a system diagram as also shown in FIG. 1 of the drawings.
Figure 12:
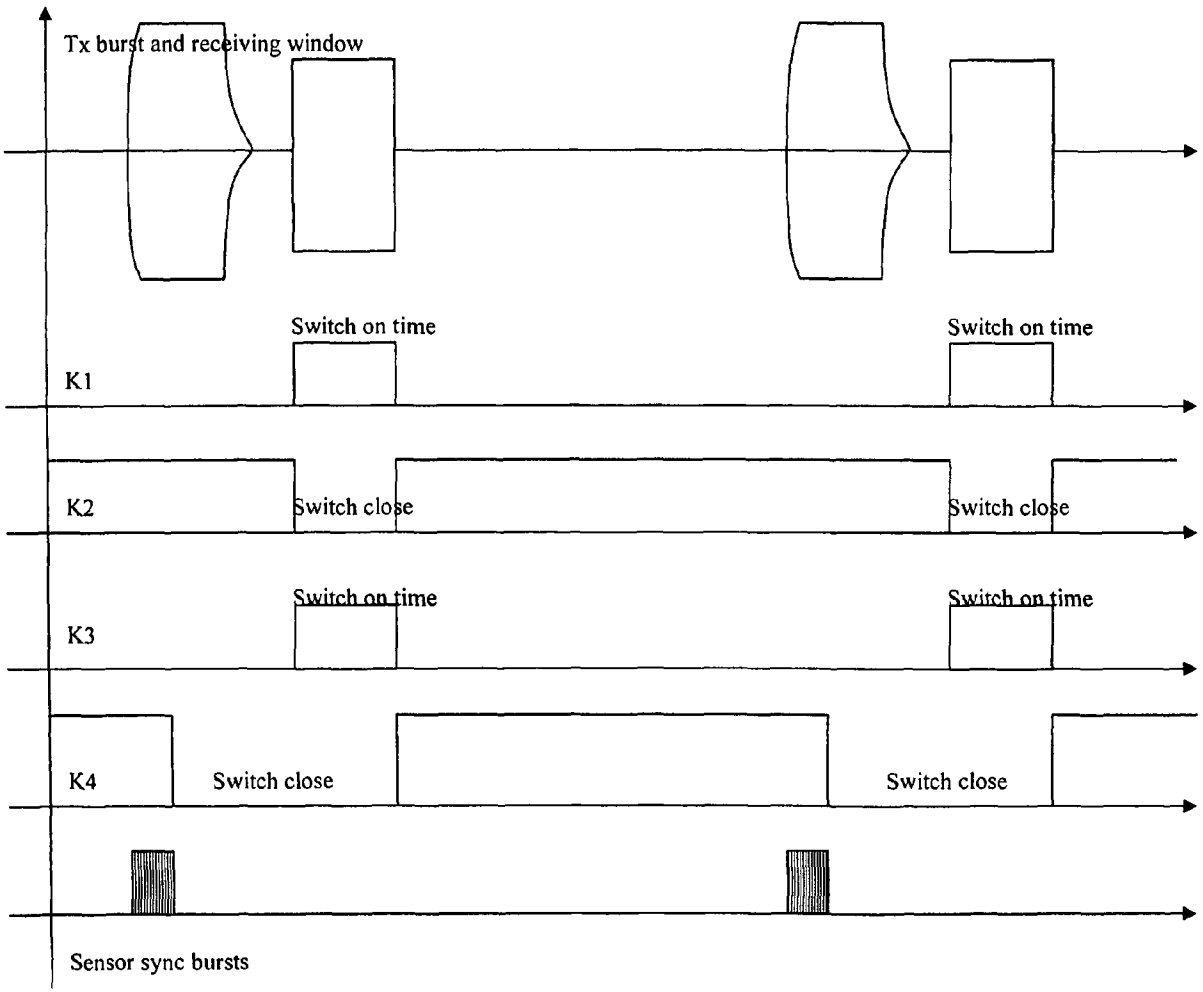
FIG. 12 shows system timing based to some extent on the illustration of the circuitry as shown in FIG. 11 of the drawings.

FIG. 12 shows the timing sequence of one embodiment of the overall system of the invention as shown in FIG. 11. The overall system topology is such that each interrogation zone or antenna has an associated distributed sub-system as shown in FIG. 11. Multiple versions of these sub-systems may then be connected via cables to a central EAS control and detection system.

As shown in the embodiment represented in FIG. 12 of the drawings, the central system produces a transmission burst. The Tx burst sensor (see FIG. 11 of the drawings) detects this burst, and the microprocessor MCU (see again FIG. 11) generates the local timing for all local signals shown in FIG. 12 of the drawings, based on the detection of the transmitted signal by the TX Burst Sensor.

During the transmission burst, the switch K1 ensures that the receiver circuit is disabled from ringing or responding to the transmission burst. Switch K2 disconnects the band-pass filter from the differential amplifier, to ensure that it also does not respond during the transmission period.

After the transmission stops, both the Tx burst sensor and MCU detect this cessation of the transmission burst, and can generate the timing signals for appropriately activating the opening and closing of the switches K1 through K4, with appropriate delays.

After some delay, K1 is set to enable detection of the tag resonant response by the highly tuned ferrite rod coil (see FIG. 11 of the drawings). Switch K2 connects the differential amplifier (see again FIG. 11) to the band-pass amplifier (see FIG. 11) so that detected tag response can be detected by the ferrite rod coil (see FIG. 11 of the drawings), amplified with low common-mode noise by the differential amplifier (FIG. 11), band-pass filtered and amplified by the band-pass filter amplifier (FIG. 11) so that the detected signal can be transmitted over cabling to the central receiver circuit board as shown by the arrow in FIG. 11 of the drawings.

This process shows the methods and processes whereby the present invention facilitates high-gain detection of the tag signal by a tuned ferrite rod antenna (FIG. 11), differentially amplified (FIG. 11) to remove the common-mode interference from the ferrite rod circuit, band-pass filtered and amplified (FIG. 11) to remove out of band noise and to further improve signal to noise ratio, so that an improved signal to noise ratio signal can be transmitted to a receiver circuit. Signal to noise ratio is improved at each stage shown in FIG. 11 of the drawings by the progressive steps of the tuned circuit (ferrite rod antenna), common-mode rejection (differential amplifier), and band-limited amplification (band-pass amplifier).

FIG. 11 further shows the additional inventive step of providing a local timing and synchronization circuit (Tx burst sensor and MCU FIG. 11) that produces a low-jitter locally generated timing signal for producing the various switch gating signals. This may address the problems that may be associated with the additional cabling that may be necessary and noise problems that would result from a centrally generated timing or synchronization signal.

It will be appreciated that the invention is not limited to the precise details and construction as described and illustrated herein. There are other embodiments that could achieve the same timing windows and functionality and the invention may include circuit structures that achieve the equivalent gating and timing of detection windows, filters and other functionality. The circuit diagrams are schematic and minor variations in topology are covered by the present invention.

The invention claimed is:

1. An EAS system comprising:

a central circuit for sequentially generating signal bursts; at least one local transmitting antenna remote from the central circuit for receiving and propagating the signal bursts into an interrogation zone;

a receiver associated with said at least one local transmitting antenna for detecting the presence of an electronic tag in the interrogation zone by means of a response tag signal to the central circuit;

a synchronization device for detecting the signal burst propagated from said at least one local transmitting antenna, the synchronization device controlling the activation of the receiver for the purpose of receiving the response tag signal based on the timing of the signal burst;

a differential amplifier, a band pass filter amplifier, a Tx burst sensor;

switches for controlling the differential amplifier, band pass filter amplifier, Tx burst sensor; and a microprocessor (MCU) to provide timing control of the switches.

2. An EAS system as claimed in claim 1 wherein said at least one local transmitting antenna comprises a plurality of local transmitting antennas each positioned in a different location.

3. An EAS system as claimed in claim 1 further comprising means for increasing the signal to noise ratio of the return tag signal.

4. An EAS system as claimed in claim 3 wherein the means for increasing signal to noise ratio comprises a differential amplifier for amplifying the return tag signal and/or suppressing common mode noise.

5. An EAS system as claimed in claim 3 wherein the means for increasing signal noise to ratio comprises a band pass filter for conditioning the return tag signal to reduce environmental noise.

6. An EAS system as claimed in claim 2, wherein the central circuit comprises a receiver circuit board for receiving multiple channels from said plurality of local transmitting antennas.

7. An EAS system as claimed in claim 2, wherein the central circuit comprises a universal multiple channel control unit connected to said plurality of local transmitting antennas.

8. An EAS system as claimed in claim 1 wherein the receiver includes a receiving antenna which is comprised of a ferrite rod front end antenna.

9. An EAS system as claimed in claim 8 wherein the ferrite rod front end antenna comprises an LC circuit which is comprised of a ferrite rod coil connected in parallel with at least one capacitor.

10. An EAS system as claimed in claim 1 wherein the operating frequency of the antenna is selected based on local conditions.

11. An EAS system as claimed in claim 10 wherein the operating frequency of the antenna is about 58 kHz.

12. An EAS system as claimed in claim 1 wherein several receivers are provided locally, some of the receivers being mounted substantially vertically and other receivers being mounted substantially horizontally to provide fuller coverage for detecting the tag in the interrogation zone.

13. An EAS system as claimed in claim 1 wherein the synchronization device comprises said Tx burst sensor for detecting the signal bursts.

14. An EAS system as claimed in claim 1 wherein the synchronization device comprises said microprocessor (MCU) to provide synchronization detection and timing control signals for switching elements to reduce ringing.

15. An EAS system as claimed in claim 8 wherein the ferrite rod front end antenna is selected so to detect the transmission burst with precision.

16. An EAS system as claimed in claim 1 wherein the transmission burst from the central circuit is used to generate local synchronization signals for the local transmitting antenna and receiver to achieve effective monitoring of the interrogation zone.

17. An EAS system as claimed in claim 1 further comprising means for suppressing transients resulting from the signal burst so that a detection window during which the receiver operates is sufficiently quiet to detect only the return tag signal.

18. An EAS system as claimed in claim 17 wherein the detection window opens after a timed preselected delay.

19. An EAS system as claimed in claim 8 wherein the ferrite rod antenna is switched off during the signal burst.

20. An EAS system as claimed in claim 1 further comprising a cable for transmitting the return tag signal to the central circuit.

21. An EAS system as claimed in claim 1 wherein the receiver includes a receiving antenna.

22. An EAS system as claimed in claim 1 wherein the receiver includes a receiving coil.

23. A local EAS detection device comprising:

at least one local transmitting antenna for receiving sequentially generated signal bursts from a central remote circuit and transmitting the signal bursts into an interrogation zone;

a receiver associated with said at least one local transmitting antenna for detecting the presence of an electronic tag in the interrogation zone by means of a return tag signal from the electronic tag and transmitting the return tag signal to the central circuit;

a synchronization device for detecting the signal burst transmitted from said at least one local transmitting antenna, the synchronization device controlling the activation of the receiver for the purpose of receiving the return tag signal based on the timing of the signal burst;

a differential amplifier, a band pass filter amplifier, and a Tx burst sensor;

switches for controlling the differential amplifier, band pass filter amplifier, and Tx burst sensor; and a microprocessor (MCU) to provide timing control of the switches.

24. An EAS detection device as claimed in claim 23 wherein the receiver comprises a ferrite rod front end antenna.

25. An EAS detection device as claimed in claim 23 wherein the synchronization device comprises said microprocessor (MCU) to provide synchronization detection and timing control signals for switching elements to reduce ringing.

* * * * *